United States Patent [19]

Riccobono

[11] 4,350,978

[45] Sep. 21, 1982

[54] HUMIDITY-SENSITIVE BROKEN PANEL ALARM

[76] Inventor: Paul J. Riccobono, 180 Grant Ave., Cresskill, N.J. 07626

[21] Appl. No.: 257,000

[22] Filed: Apr. 24, 1981

[51] Int. Cl.[3] ..... G08B 13/20

[52] U.S. Cl. ..... 340/550; 340/602; 340/626

[58] Field of Search ..... 340/550, 602, 605, 626; 49/13; 52/172, 171

[56] References Cited

U.S. PATENT DOCUMENTS

| | | | |
|---|---|---|---|
| 1,974,779 | 9/1934 | Lupold et al. | 340/550 |
| 2,279,582 | 4/1942 | Russel | 236/44 R |
| 3,441,924 | 4/1969 | Peek et al. | 340/550 |
| 3,594,763 | 7/1971 | Peek | 340/626 |
| 4,127,763 | 11/1978 | Roselli | 219/203 |
| 4,197,530 | 4/1980 | Laue | 340/602 |

*Primary Examiner*—Glen R. Swann, III

*Attorney, Agent, or Firm*—James & Franklin

[57] ABSTRACT

A burglar alarm system to detect the breaking of a pane of a sealed multiple pane panel comprises in one embodiment a sensor responsive to the humidity intermediate the panes of the panel, a burglar alarm, and a microprocessor or detector operably connected to the sensor and alarm, the detector being adapted to actuate the alarm when the sensor detects a change in the humidity. In a preferred embodiment the system comprises a sensor responsive to an atmospheric parameter (such as humidity or pressure) intermediate the panes of the panel, a burglar alarm, a slow leak warning device, and a detector operably connected to the sensor on the one hand and the alarm and warning device on the other hand. The detector actuates the alarm when it detects a rapid increase in the parameter being sensed by the sensor, such a rapid increase being indicative of a broken pane such as might occur in the course of a burglary, and actuates the warning device and when it detects a more gradual change in the parameter being sensed, and the parameter being sensed exceeds a certain predetermined limit, this being interpreted as a defective seal in the panel.

14 Claims, 2 Drawing Figures

HUMIDITY-SENSITIVE BROKEN PANEL ALARM

BACKGROUND OF THE INVENTION

The present invention relates to a burglar alarm system, and more particularly to such a system designed to detect the breaking of a pane of a sealed multiple pane panel.

U.S. Pat. Nos. 1,974,779 and 3,441,924 disclose pressure-sealed double paned windows with a low pressure or vacuum interior within which a pressure sensor is positioned for detecting a change in pressure, as might result from a window broken in the course of a burglary, and consequently triggering a burglar alarm. While such an alarm system may be useful for pressure-sealed multiple pane panels having a low pressure or vacuum interior or even a high pressure interior, sealed multiple pane panels are presently available with an interior in which the pressure is neither much higher nor much lower than atmospheric, the interior simply being filled with a dry inert gas (such as nitrogen) at approximately atmospheric pressure. Obviously the pressure-based alarm systems described in the aforementioned patents are not useful with such pressure-sealed multiple pane panels and recourse must be had to some non-pressure sensitive alarm system for such panels.

The aforementioned pressure-sensitive burglar alarm systems, and indeed all other burglar alarm systems dependent upon the maintenance of a particular atmospheric parameter within the interior of a sealed multiple pane panel, are incapable of distinguishing between a sharp change in the atmospheric parameter (e.g. pressure) such as might result from a window broken in the course of an attempted burglary, and a gradual change therein, such as might result from aging of the window seals or a structural defect in the window. Thus the prior art burglar alarm systems based on an atmospheric parameter within a sealed interior tend to give a high number of "false" alarms. Not only do such false alarms result in an unnecessary expenditure of energy in mobilizing anti-burglary resources, but, over a period of time, tend to reduce faith in the reliability of the system and result in people ignoring alarms whether they be false or real alarm situations.

Accordingly, it is an object of the present invention to provide a burglar alarm system which in one embodiment is based on an atmospheric parameter other than pressure.

Another object is to provide such a system which—whether pressure-sensitive or not—is in another embodiment capable of distinguishing between low level leakage and the breaking of a pane.

A further object is to provide a burglar alarm system which is simple, inexpensive, easy to maintain and reliable.

SUMMARY OF THE INVENTION

It has now been found that the above and related objects of the present invention are obtained in a burglar alarm system to detect a breaking of a pane of a sealed multiple pane panel. In one embodiment the system comprises a humidity sensor, the status of the sensor being responsive to the humidity intermediate the panes of a humidity sealed multiple pane panel, alarm means, and detector means operably connected to the sensor and alarm means and adapted to actuate the alarm means in response to a predetermined status of the sensor.

Preferably the detector means actuates the alarm means in response to a predetermined minimum level of humidity indicated by the status of the sensor, or in response to a predetermined minimum rate of change in the status of the sensor or in response to a predetermined minimum rate of increase in the humidity indicated by the status of the sensor. Furthermore the detector means is preferably capable of discriminating between a gradual and a sharp rate of increase.

The burglar alarm system described above is especially well-suited for use in pressure sealed multiple pane panels wherein the interior of the panel is initially at or about atmospheric pressure so that a pressure-sensitive burglar alarm system would not be useful.

The present invention further comprises a panel for use in connection with a burglar alarm system as described above comprising a humidity sealed multiple pane panel defining a humidity sealed cavity therein, a humidity sensor in operative communication with the said cavity, and electric lead means operatively secured to the sensor and extending outwardly of the panel. Typically the sensor is disposed within the cavity and the electrical lead means extends outwardly of the cavity.

In a preferred embodiment the present invention comprises a burglar alarm system to detect the breaking of a pane of a sealed multiple pane panel comprising a sensor, the status of the sensor being responsive to a predetermined atmospheric parameter (such as humidity or pressure) intermediate the panes of the sealed multiple pane panel, alarm means to indicate the breaking of a pane and the probable occurrence of a burglary, warning means to indicate a slow loss of window seal integrity, and detector means operably connected on the one hand to the sensor and on the other hand to the alarm and warning means. The detector means includes means for discriminating between a gradual and a sharp rate of increase over time in the value of the parameter indicated by the sensor, the detector means actuating the warning means in response to a gradual rate and actuating the alarm means in response to a sharp rate.

Preferably the detector means is adapted to actuate the alarm means in response to a predetermined minimum percentage change over a time interval in the value of the parameter indicated by the sensor and to actuate the warning means in response to a lesser percentage change when the value of the parameter indicated by the sensor exceeds a predetermined limit. It will be appreciated that the detector means actuates the alarm means without regard to whether or not the warning means is also actuated so that the system acts as a burglar alarm system even when there is also a slow leak in the panel. Because this system reduces or entirely eliminates the number of false alarms, it increases the faith of the users in the reliability of the system and hence increases the likelihood of their taking appropriate action upon actuation of the alarm means.

DETAILED DESCRIPTION OF THE PREFERRED EMBODIMENTS

Figure 1:
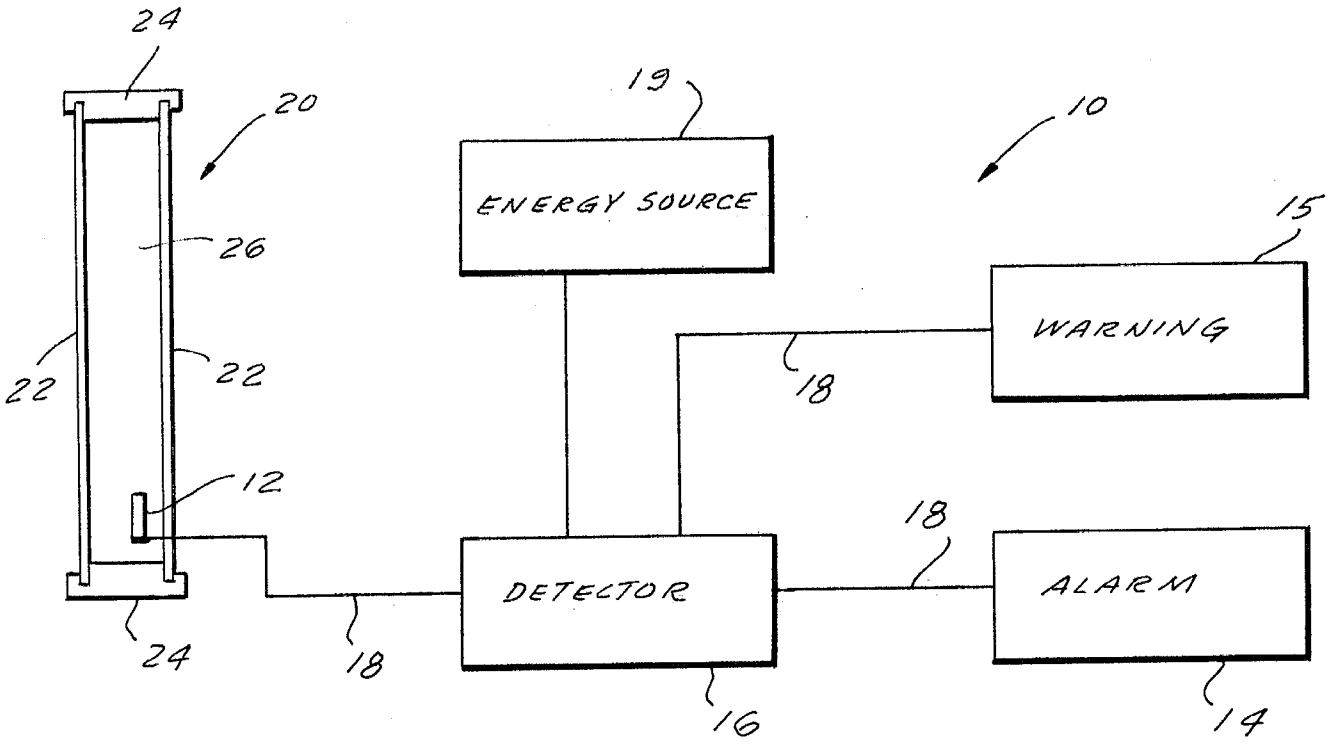
FIG. 1 is a schematic view of the principal elements of the burglar alarm system of the present invention as connected to a window panel.

Referring now to FIG. 1, therein illustrated is one embodiment of a burglar alarm system generally designated 10 according to the present invention. The burglar alarm system 10 comprises in its major aspects a humidity sensor 12, a first indicator or alarm means 14 for signalling a burglary, a second indicator or warning means 15 for signalling a slow humidity leak, and detector means 16 operably connected to both the sensor 12 and the indicator means 14, 15 by wires 18. Energy to operate the system can be provided from an external energy source 19, such as a wall outlet (not shown), operatively connected to the system (for example, to the detector means 16) or by a self-contained means, such as a battery disposed within the system (for example, within the detector means 16). While the detector means 16 will typically be disposed within the enclosure to be protected by the burglar alarm system 10, the indicator means 14, 15 may be disposed either within the enclosure or external thereto. For example, the alarm means 14 may comprise a flashing light or horn disposed on top of the house or a signal light disposed at a local police or guard station. Indeed, the alarm means 14 may be any conventional operative burglar alarm system, including the newest devices which are connected to telephones and automatically call police stations and report the incident. The warning means 15 will ordinarily be a simple light or low level noise emitter, preferably adjacent the detector means 16, to warn of a slow humidity leak.

As the indicator means 14, 15 are conventional in nature, they need not be further described herein.

The humidity sensor 12 is disposed within a panel 20, the panel typically being a transparent panel functioning as a window, although it may also be a transparent or opaque panel disposed within a door or elsewhere. The panel 20 comprises two panes 22 of relatively fragile material (such as glass) spaced apart in parallel relationship by spacer elements 24 therebetween, the panes 22 and spacer elements 24 being sealed together adjacent the pane edges (e.g., by a suitable sealing compound such as an epoxy resin) to preclude the passage of water vapor into the panel interior 26. The panel interior 26 is filled with a dry inert gas such as nitrogen, but the gaseous volume within the panel interior 26 may be at a pressure equal to, greater than or less than the pressure outside of the panel 20, provided only that the moisture level within the panel interior 26 is substantially less than that external to the sealed panel. Thus the present invention is useful even in sealed panels having interiors at or near atmospheric pressure.

While in the embodiment illustrated in FIG. 1 the sensor 12 is disposed in its preferred location—namely, within the panel interior 26—the sensor 12 may alternatively also be disposed externally of the panel 20 as long as it is in a volume operatively communicating with the panel interior 26 and effectively sealed against the atmosphere. Electrical lead means 18 extend through one pane 22 or spacer 24, thereby to connect the sensor 12 and detector means 16, the electrical lead means 18 being sealed to the pane 22 or spacer 24 to preclude passage of moisture vapor through the interface.

Humidity sensors are well known and are described in such publications as "Instruments and Control Systems" (June, 1963), page 93, "Instrumentation Technology" (July, 1974), page 49 and "Humidity Sensors" a publication of Phys-Chemical Research Corp., New York, N.Y. 10011. A sensor may be selected which responds to any of the known forms for reporting humidity: relative humidity, absolute humidity (either vapor pressure or vapor density), dew point, or humidity ratios (specific humidity, weight fraction, or mole fraction). The response of the sensor to a variation in the humidity parameter being monitored is typically reflected in a change in the resistance of the sensor, the resistance remaining relatively flat and increasing only slightly until a certain humidity is reached, and then sharply increasing.

The detector means 16 may be a microprocessor such as the MOS/LSI one-chip microcomputers (TMS 1000 Series) available from Texas Instrument Incorporated. The detector means 16 will be programmed to convert the electrical resistances exhibited by the sensor 12 into humidity values (or values proportional thereto) and to detect the change in the humidity as a function of a change in time. A significant change of resistance in a short period of time (for example, a change of more than 10% in humidity over a 15 second interval) would be interpreted by the detector means as a burglary involving a breaking of the integrity of the window 20, and the detector means 16 would therefore actuate the first indicator or alarm means 14. A smaller change in resistance over the same period of time would be interpreted as simply slow leakage in the window (rather than a burglary) and would not cause the detector means 16 to trigger the alarm means 14. On the other hand, once the humidity equalled or exceeded a certain predetermined limit indicative of the fact that the window seal was no longer secure, the detector means 16 would actuate the second indicator or warning means 15. After actuation of the warning means 15, detector means 16 would continue to monitor the humidity to determine whether the criterion described above for determining the actuation of the alarm means 14 has also been met, and if so, would actuate the alarm means 14. Thus, even if in the course of a burglary a window already having a slow leak is broken, the alarm 14 will be set off so long as there exists at least a 10% difference between the humidities outside and within the leaky window prior to breakage. No false alarm is given by the system because the detector means 16 will not actuate the alarm means 14 merely because a window 20 with a slow leak has undergone a change of at least 10% in humidity as the humidity initially read and stored as a reference point in the detector means memory is updated every 15 seconds.

Figure 2:
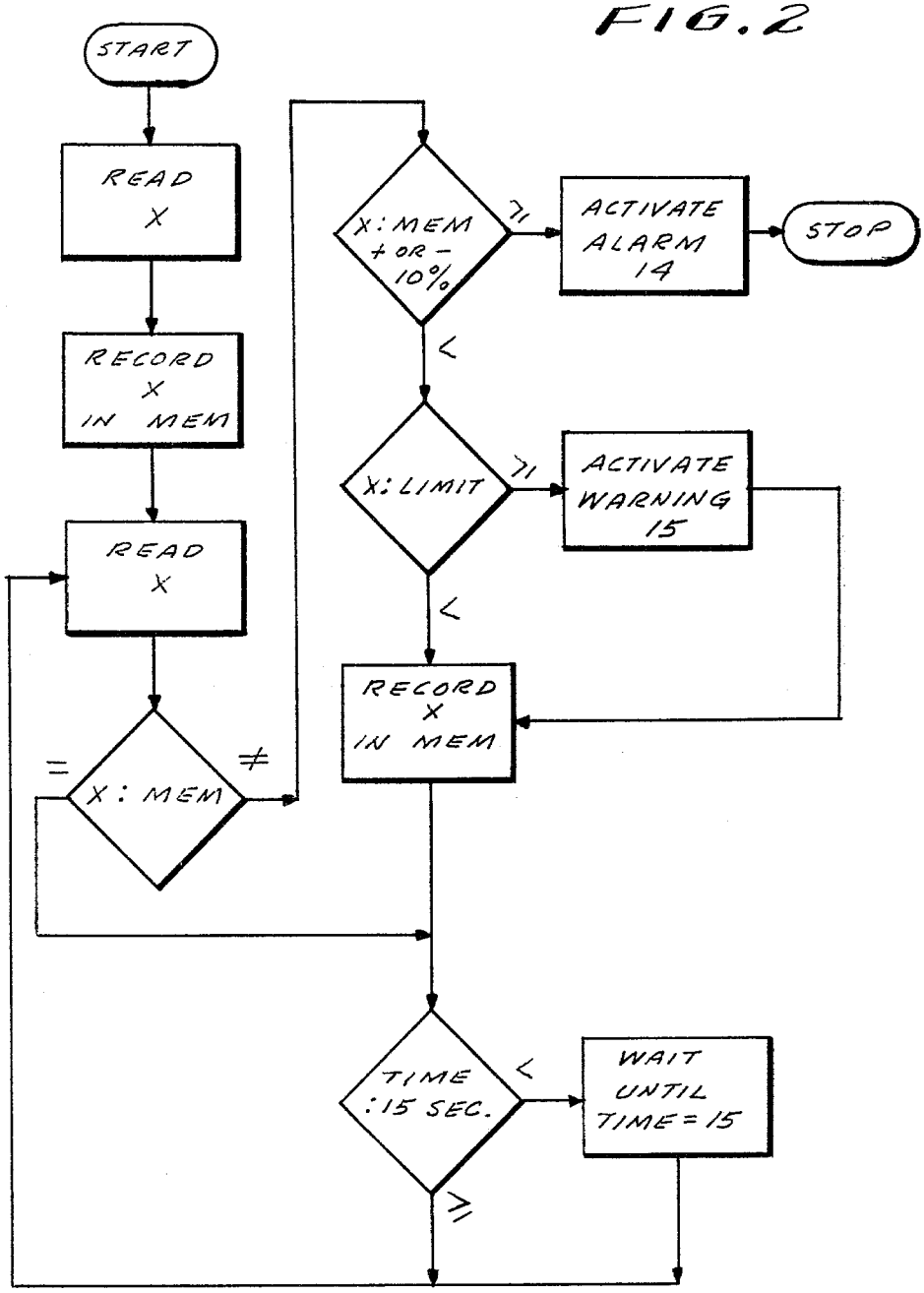
FIG. 2 is a flow chart of the burglar alarm system mode of operation.

Referring now to FIG. 2, therein illustrated is a flow chart for the burglar alarm system of the present invention. The humidity X is initially read from the sensor 12 of the window 20 and then recorded by the detector means 16 in memory. The humidity is then read again and a timer started within the detector means 16. The last read humidity is compared for equality with that stored in memory. If the two are not equal and the last read humidity has increased or decreased relative to that stored in memory by 10% or more, the alarm means 14 is actuated and no further action is taken. On the other hand, if the last read humidity is not equal to that stored in memory and there is less than a 10% discrepancy, the last read humidity is compared with a predetermined humidity limit stored in the detector means 16, the predetermined limit indicating the point at which the window seal is deemed no longer secure. If the last read humidity is equal to or exceeds the limit, the warning means 15 is actuated. Unless the alarm means 14 has been set off or there was identity between the last read humidity and that stored in memory, the last read humidity is substituted for that stored in memory. In any case, unless the alarm means 14 has been actuated, the timer is checked to insure that at least 15 seconds have elapsed from the last humidity reading and, if not, the system is put on hold. Once the 15 seconds have elapsed, the procedure is repeated all over again, starting with the reading of the humidity and the starting of the timer.

The detector means 16 must be preprogrammed to convert the resistance readings from the sensor 12 into humidity readings (or a proportional value) and a predetermined humidity reading limit (or other proportional value) indicative of loss of window seal integrity must be preprogrammed into the detector means memory. Obviously, the aforedescribed "10% change of humidity over a 15 second interval" test is only one of many that can be employed, others varying the percentage change in humidity and/or the time interval involved. Indeed, in more elaborate embodiments of the present invention, it may be possible to have the percentage figure, the limit figure and the time interval figure entered by the ultimate user through appropriate data-entry mechanisms in the detector means 16.

While the principles of the present invention have been described above broadly in the context of a burglar alarm system based on humidity levels, the same principles are equally applicable to a burglar alarm system based on pressure levels, provided that the normal pressure levels in the panel interior were substantially different from the prevailing atmospheric pressure. In such an embodiment the sensor 12 would detect the pressure within the sealed chamber of the window 20 and the detector means 16 would convert the sensor output into pressure values (or values proportional thereto) and then act upon the pressure values much as it acts on the humidity values, as described above, to determine the appropriateness of actuating alarm or warning means.

To summarize, the present invention provides a novel burglar alarm system which is simple, inexpensive, easy to maintain and reliable. In one embodiment, the burglar alarm system is based on the sensing of a change in humidity within the panel interior, this embodiment being particularly useful in those instances where the panel interior is initially at or about atmospheric pressure so that a burglar alarm system based on the sensing of a change in pressure within the panel interior would not be useful. In another embodiment, the burglar alarm system—whether based on the sensing of variations in pressure or humidity within the panel interior—is capable of distinguishing between low level leakage and the breaking of a pane, thereby reducing the number of false alarms given and enhancing the faith of the users in the reliability of the system.

Now that the preferred embodiments of the present invention have been shown and described, various modifications and improvements therein will be readily apparent to those skilled in the art. Accordingly, the spirit and scope of the present invention is to be limited only by the appended claims, and not by the foregoing description.

I claim:

1. A burglar alarm system to detect the breaking of a pane of a humidity sealed multiple pane panel, comprising (A) a humidity sensor, the status of said sensor being responsive to the humidity intermediate the panes of the humidity sealed multiple pane panel;

(B) alarm means; and (C) detector means operably connected to said sensor and said alarm means and adapted to actuate said alarm means in response to a predetermined status of said sensor, said detector means being capable of discriminating between a gradual and a sharp rate of increase in the humidity indicated by the status of said sensor, said detector means initiating a first action in response to a sharp rate and a second action in response to a gradual rate.

2. The system of claim 1 wherein said first action comprises actuation of said alarm means.

3. The system of claim 2 including warning means to indicate a slow loss of window seal integrity, and wherein said second action comprises actuation of said warning means.

4. The system of claim 3 wherein said detector means is adapted to initiate said first action irrespective of whether or not said second action has been initiated.

5. The system of claim 1 wherein said detector means is adapted to initiate said first action irrespective of whether or not said second action has been initiated.

6. The system of claim 1 wherein said sensor is disposed intermediate said panes.

7. The system of claim 1 further including:

(A) a humidity sealed multiple pane panel defining a humidity sealed cavity therein, said sensor being in operative communication with said cavity, and (B) electric lead means operatively secured to said sensor and extending outwardly of said panel.

8. The system of claim 7 wherein said sensor is disposed within said cavity, said alarm means is disposed without said panel, and said electrical lead means operatively connects said sensor and said alarm means.

9. The system of any one of claim 1 wherein said detector means initiates said second action in response to a gradual rate only after the status of said indicator exceeds a predetermined limit.

10. A burglar alarm system to detect the breaking of a pane of a sealed multiple pane panel, comprising (A) a sensor, the status of said sensor being responsive to a predetermined atmospheric parameter intermediate the panes of the sealed multiple pane panel;

(B) alarm means to indicate the breaking of a pane and the probable occurrence of a burglary;

(C) warning means to indicate a slow loss of window seal integrity;

(D) detector means operably connected on the one hand to said sensor and on the other hand to said alarm and warning means, said detector means including means for discriminating between a gradual and a sharp rate of increase over time in the value of said parameter indicated by said sensor, said detector means actuating said warning means in response to a gradual rate and actuating said alarm means in response to a sharp rate.

11. The system of claim 10 wherein said detector means is adapted to actuate said alarm means in response to a predetermined minimum percentage change in the value of said parameter indicated by said sensor and to actuate said warning means in response to a lesser percentage change when the value of said parameter indicated by said sensor exceeds a predetermined limit.

12. The system of claims 10 or 11 wherein said detector means actuates said alarm means without regard to whether or not said warning means is also actuated.

13. The systems of claim 10 wherein said detector means stores and compares the parameter values at the beginning and end of a predetermined minimum time interval and, when said alarm means is not actuated, updates the beginning parameter value with the end parameter value.

14. The system of claim 10 wherein said detection means actuates said warning means in response to a gradual rate only when the value of said parameter indicated by said sensor exceeds a predetermined limit.

* * * * *